US005417636A

United States Patent [19]

Havens

[11] Patent Number: 5,417,636

[45] Date of Patent: May 23, 1995

[54] BODY STRETCHING AND EXERCISE MAT SYSTEM

[76] Inventor: Suzanne Havens, 8549 E. Laredo La., Scottsdale, Ariz. 85250

[21] Appl. No.: 86,304

[22] Filed: Jul. 6, 1993

[51] Int. Cl.[6] ..... A63B 26/00

[52] U.S. Cl. ..... 482/145; 482/142; 482/140; 482/907

[58] Field of Search ..... 482/123, 130, 140, 145, 482/907, 908, 23, 142

[56] References Cited

U.S. PATENT DOCUMENTS

| | | | |
|---|---|---|---|
| 3,567,218 | 3/1971 | Johnson | 482/140 |
| 3,620,530 | 11/1971 | Cosby | 482/130 |
| 4,492,376 | 1/1985 | Schatz et al. | 482/130 |
| 4,609,192 | 9/1986 | Bratcher | 482/145 |
| 5,100,130 | 3/1992 | Shoebrooks | 482/145 |

*Primary Examiner*—Stephen R. Crow
*Attorney, Agent, or Firm*—Gregory J. Nelson

[57] ABSTRACT

A body exercising and stretching mat having a resilient surface. The mat folds into several sections along a hinge line for easy storage. The mat has a plurality or stations arranged on the mat. One or more handles or grips may be selectively inserted into the stations. The user sits on the mat and reaches outwardly to grasp the handles to provide stability and to provide a progressive measure of exercise progress. The mat may also be used with a toe bar which is positionable to assist the user in doing other types of exercises such as sit-ups. Elastic bands may be attached to either the toe bar or at selected stations for additional stretching and exercising capability.

12 Claims, 2 Drawing Sheets

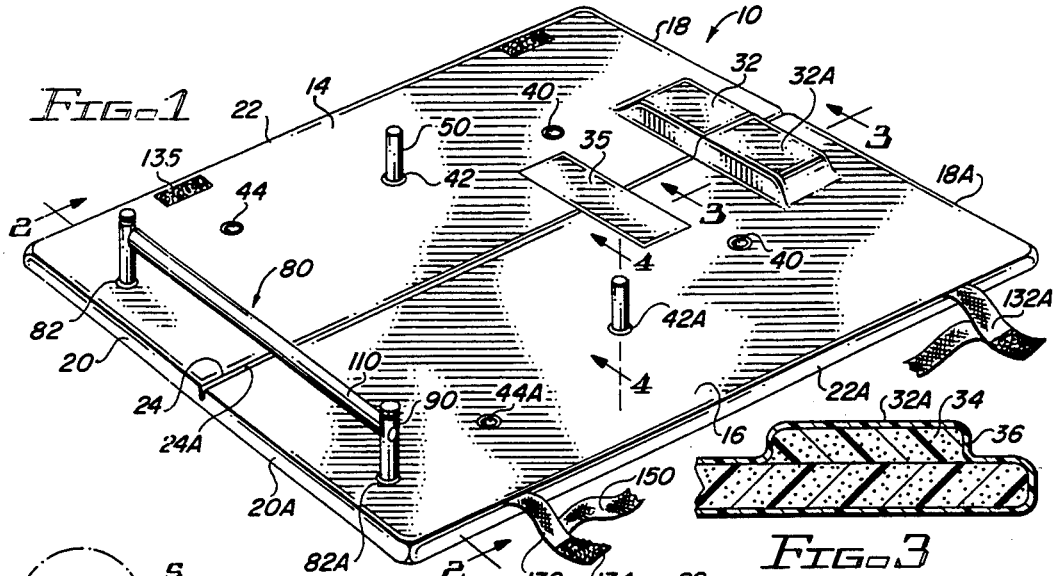
FIG. 1
10
18
14
22
32
32A
40
50
42
35
3
18A
135
44
2
80
82
20
24
24A
110
90
44A
4
42A
132A
22A
32A
34
36
16
150
20A
82A
132
134
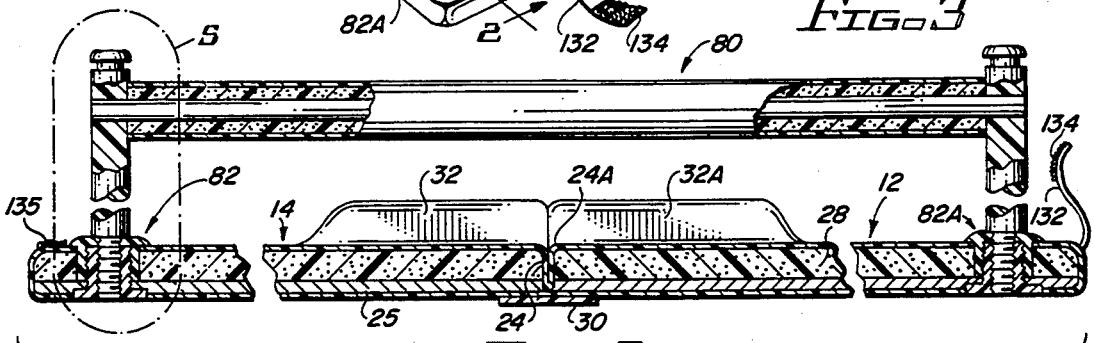
FIG. 3
5
80
134
82
32
24A
32A
12
135
14
28
82A
132
25
24
30
FIG. 2
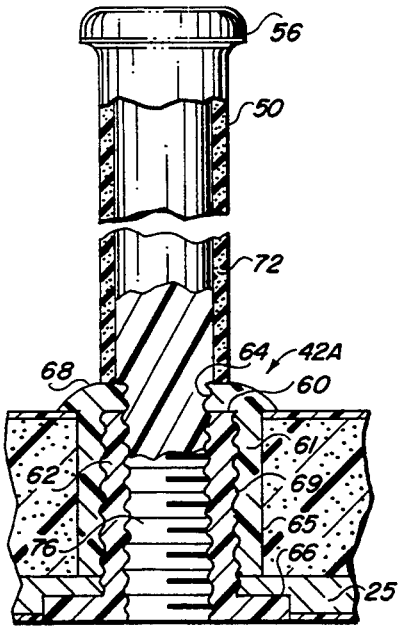
56
50
72
64
42A
68
60
61
62
69
65
76
66
25
FIG. 4
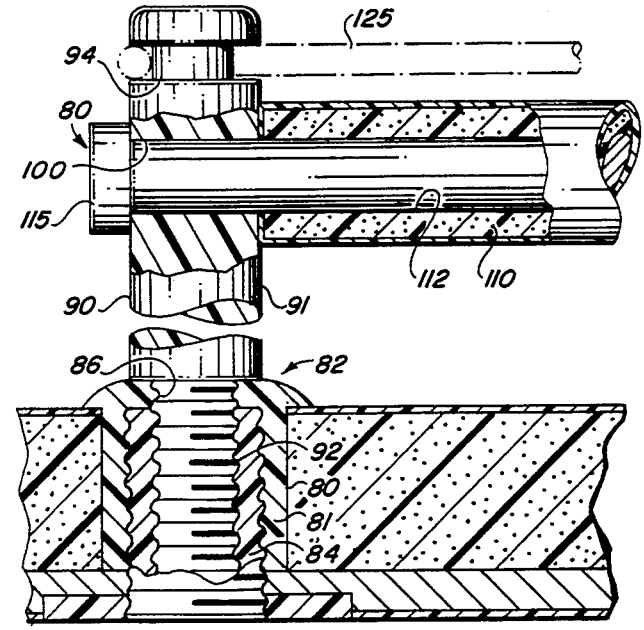
125
94
80
100
115
112
110
90
91
86
82
92
80
81
84
FIG. 5

BODY STRETCHING AND EXERCISE MAT SYSTEM

FIELD OF THE INVENTION

The present invention relates to an athletic training system and more particularly relates to a system including a portable floor mat on which exercises are performed for progressively stretching the muscles of the human body.

BACKGROUND OF THE INVENTION

The importance of flexibility and stretching prior to and after strenuous exercise is well recognized. Stretching helps to prevent possible injuries. If a cold, tight muscle is suddenly shocked into a violent contraction, as for example by rapid running with no warm-up, the muscle may tear, pull or strain. An injury may also occur in the muscle facia, the sheath covering the muscle, to a tendon, ligament or cartilage injury which can be painful and debilitating. Warming the muscle fibers prior to exercise allows them to be more flexible to meeting the demands of the exercise program.

It is also well recognized that it is important to cool down or stretch the muscles after a rigorous exercise program, again to avoid possible injury to the muscles, tendons, ligaments and cartilage.

Some preliminary and cooling-down stretching exercises may be done in a standing position with the individual assuming a stretched position for a period of time. For example, the individual may bend from the waist touching a location such as an ankle or toe.

DESCRIPTION OF THE PRIOR ART

If a more complete set of stretching exercises are to be done, it is generally necessary to do some from a sitting position. Gymnasium mats have been available for many years to provide a soft, more comfortable surface upon which a person can sit while limbering and stretching muscles in various positions. Various exercise and stretching mats and devices can also be found in the prior art.

For example, U.S. Pat. No. 3,319,271 shows a gymnasium mat constructed as a unit having a flexible filler material which unit is hinged for convenience of storage.

U.S. Pat. No. 3,670,346 shows a floor mat having a plurality of individual sections connected together by a top sheet so that the entire mat can be roll-folded inwardly from its ends to form a long narrow stack of mat sections.

U.S. Pat. No. 4.264.069 shows a therapeutic device having a semi-circular connecting member and outwardly extending arms. The device is used for activities involving depth perception, color coordination and general shoulder movement for a range of motion.

U.S. Pat. No. 4.506,884 shows a muscle stretching and exercising system having a pair of carts which are cushioned. The user grasps the handle and supports one leg on each cart to stretch the muscles.

U.S. Pat. No. 4.905,990 discloses a portable exercise mat having two units. The mat body is foldable into two segments. One of the segments has a pocket for storing items. The extension pad may be removed to conform to different exercise requirements.

U.S. Pat. No. 4,908,887 discloses a portable, foldable utility mat having a plurality of flexibly or hingedly connected ribs formed from a flat rigid core sandwiched between light weight insulating cushioning material. The mat can be rolled up and rolled out flat without curling.

While the above exercise systems and mats as well as others found in the prior art provide certain advantages of portability and also serve to make floor exercising more comfortable, there nevertheless exists a need in the art for an improved body exercising and stretching system, particularly for floor exercises.

BRIEF SUMMARY OF THE INVENTION

In accordance with that need, the present invention as a broad object provides such a system having a portable floor exercise mat which includes a plurality of exercise stations having grips or handles to assist in the stretching movements adding resistance and stability.

It is another object of the present invention to provide an exercise system which includes a resilient mat which has stations against which the individual can measure his or her progress while stretching on a comfortable surface.

It is another object of the present invention to provide a compact and easily transportable exercise mat which provides the user with a versatile selection in the types of exercise that may be done.

Briefly, in accordance with the foregoing, the present invention comprehends an exercise and stretching mat with a rigid backing panel covered by a resilient material and having an outer covering of a cloth fabric or protective vinyl. The mat is preferably formed in several sections hinged together for convenience of storage and transportation. The user will normally sit on the mat with the user's legs outstretched. A plurality of exercise stations are located in the mat preferably located on centers on lines that diverge outwardly from a seat area. The seat area may include additional padding. Handles or grips may be selectively placed in the work stations. Graphics and instructions may be imprinted on the surface of the mat or may be included in a separate instructional video tape. In use, the stations provide locations which the user can grasp for stability while stretching and as flexibility increases the individual can progress to stations located farther from the seat area and accordingly measure the increase in flexibility.

The device may also be used with a toe bar which is removably insertable in stations located adjacent an edge of the mat opposite the area where the user normally is seated. The toe bar will assist in performing certain exercises such as abdominal strengthening exercises. Elastic bands may be attached to the toe bar or the individual stations for additional stretching exercise capability.

BRIEF DESCRIPTION OF THE DRAWINGS

FIG. 1 is a perspective view of the exercise system of the present invention;

FIG. 2 is a sectional view taken along line 2—2 of FIG. 1;

FIG. 3 is a sectional view taken along line 3—3 of FIG. 1;

FIG. 4 is a sectional view taken along line 4—4 of FIG. 1;

FIG. 5 is a detail view as indicated in FIG. 2; and

DETAILED DESCRIPTION OF THE INVENTION

Figure 6A:
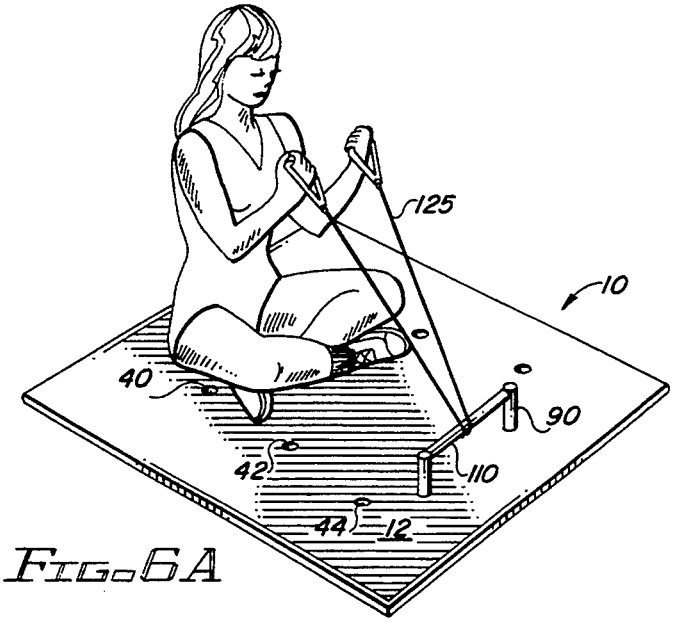
FIGS. 6A to 6C illustrate the system in use with various representative exercise positions shown.

Turning to the drawings, particularly FIGS. 1 to 5, the exercise and stretching system of the present invention is shown and is generally designated by the numeral 10. The system includes a mat 12 having adjoining sections 14 and 16. Section 14 is generally rectangular having opposite ends 18 and 20 and outer edge 22. Inner edge 24 is parallel to outer edge 22. Section 16 is similarly configured having opposite ends 18A and 20A, outer edge 22A and inner edge 24A. Each of the sections 14 and 16 are similarly constructed having a rectangular rigid backing panel 25 which may be of plastic or suitable material such as ½" thick plywood. The upper surface of panel 25 is covered with a layer 28 of resilient cushioning material such as foam rubber or material such as an expanded polyethylene, expanded polypropylene or expanded polyurethane. These materials are well suited for this in that they are generally light weight and provide a desired resilience. Typically the thickness of the foam layer is approximately ½" to 1½" in thickness. The entire sections 14 and 16 are each encased in an outer covering which may be fabric but is preferably a plastic covering such as polyvinyl chloride or polyethylene of suitable thickness. The mat assembly, consisting of the rigid base, a substrate of resilient material and covering can be fabricated by any conventional methods either sewn construction or with the covering being sonically welded, sewn or otherwise secured. The dimensions of the mat 12 may vary but typically will be approximately 4 to 5 feet square.

The individual mat sections 14 and 16 are positioned with their inner edges 24 and 24A adjacent one another. A fabric hinge 30 extends along the edges on the bottom of the mat to hingedly join the sections together. The mat sections 14 and 16 may then be folded with their bottom surfaces in juxtaposition for compactness for storage and transportation.

As indicated, the body exercising and stretching system of the present invention is intended primarily for floor exercise of the type in which the individual exercising is seated on the upper surface of the mat near one edge with the legs outstretched. Accordingly, for the comfort of the user, each of the sections 14 and 16 may be provided with optional seat areas which for comfort may have additional padded seat sections 32 and 32A. The padded seat sections include an interior core 34 of a suitable resilient material with an outer covering 36 extending over the resilient core and secured to the upper surface of the pads by sewing, bonding or other conventional fabrication techniques. The covering over the seat sections may be part of the covering extending over the mat sections. Pad 32A is similarly fabricated. The seat sections may also simply be an area designated as such without the additional padding.

Figure 6B:
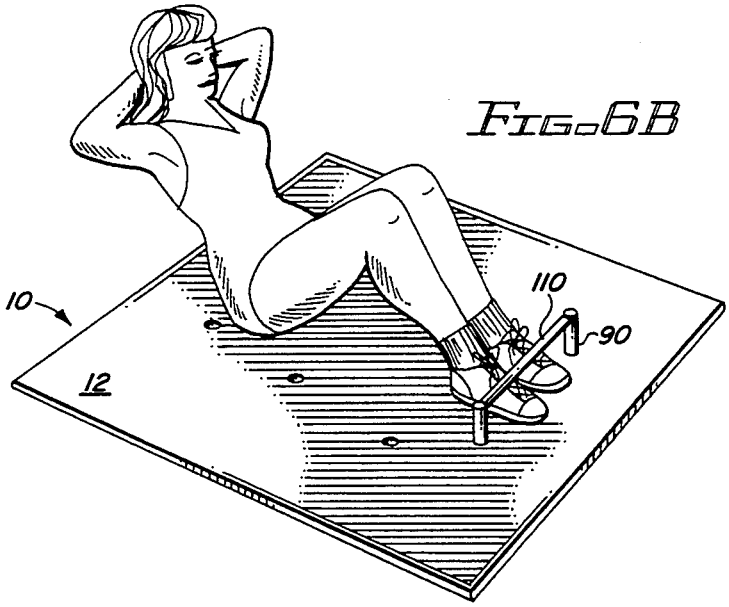
Figure 6C:
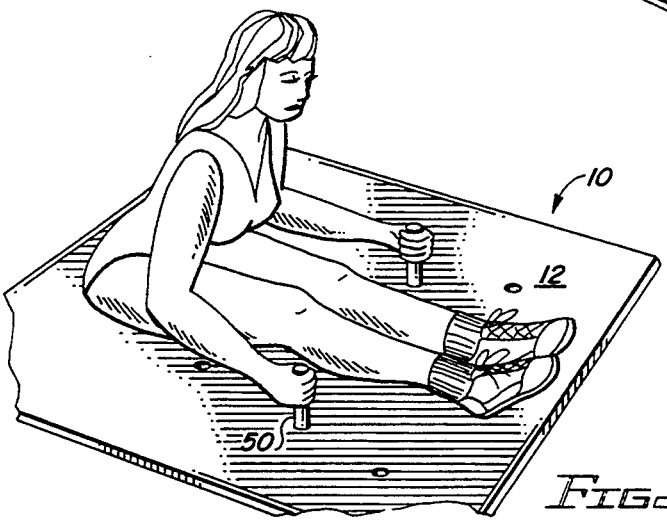

The two seat sections are preferably positioned a few inches inward of edges 18 and 18A and extend laterally from the respective edges 24 and 24A of the sections 14 and 16. The seat area provides a location on which the individual sits with the user's legs outstretched in front of the user facing opposite ends 20 and 20A of the mat sections. This is best illustrated in FIGS. 6A to 6C. Instructional information and graphics may be provided in a visually convenient area such as at area 35 or may be provided in a separate audio or videotape.

A plurality of stations 40, 42 and 44 are provided in mat section 20. Similarly, a plurality of stations 40A, 42A and 44B are provided in mat section 16. The stations are preferably arranged along a line which diverges generally from the seat area toward the opposite far corner of each of the mat sections. For example, the projected lines on which the stations are arranged form an angle with respect to one another of approximately 30° to 90°. The stations may be spaced at any suitable intervals, it being found that spacing of about 6" to 12" between the stations is suitable for most individuals. The initial stations 40 and 40A are each spaced inwardly from edges 18 and 18A about 12" to 24".

The stations provide a location and a receptacle for insertion of removable handles or grips 50 which the individual may grasp or reach to provide stability during exercising and also to provide a measure of progress as flexibility increases. As best seen in FIG. 4, the individual stations each include a first grommet member 60 having a generally cylindrical body 62 defining a threaded bore 64 and a threaded exterior 69. An annular flange 66 extends at the bottom end of the bore and provides a larger area surface which is received in the bottom surface of the rigid panel 25 for flush mounting. The grommet member 60 is secured at the underside of flange 66 to the rigid panel by any suitable means such as adhesive or a mechanical fastener. A second grommet member 61 has a cylindrical body 65 which is in threaded engagement with the exterior 69 of grommet section 60. The upper edge of the grommet member 61 is provided with an annular flange 68 having a smoothly curved upper surface which avoids presenting any sharp protrusions and which engages and compresses the mat.

The handles 50 are removably securable at the stations and to this end each of the handles has a generally cylindrical body 72 which may be approximately 6" in length. The upper end is formed having an enlarged flange 56 which will help to prevent the user's hands from slipping from the handle. The lower end of the body is provided with threaded section 76 which is engageable in the threaded bore 64 by simply twisting or rotating the handle. The handle and the grommet sections are preferably fabricated from a high strength rigid plastic such as styrene, ABS or the like. The handles may also be made of other materials such as wood or aluminum. In the normal exercising routine, the user will engage at least one handle 50 in selected stations 40 to 44 and another handle in the opposite stations 40A, 42A or 44A. The handles may be detachably insertable in other means such as having them insertable in bores without threaded engagement.

In addition to providing an exercise system for floor exercises to improve flexibility, other types of beneficial exercises may also be performed with the system. There is a need and desire on the part of many individuals to increase abdominal strength which is known to prevent or reduce lower back problems as abdominal muscles are developed. Accordingly, a toe bar assembly 80 may be detachably secured parallel to the ends 20 and 20A of the mat sections. The toe bar assembly is engageable in grommet assembly 82, 82A in each of the sections. The grommet assembly 82 is similar to that described with reference to FIG. 4 having sections 81 and 84 which are in threaded engagement and which are secured to the rigid panel 25 and each defining internal threaded bores 86.

A post 90, 90A is engageable, respectively, at each of the grommet assemblies 82 and 82A. The posts 90 and 90A are similar as seen in FIG. 5 which is representative. Each has a cylindrical body 91 having a threaded section 92 at its lower end which is engaged in the bore 86 of the grommets. An annular groove 94 extends about the upper end of the post for attachment of an elasticized exercising band as will be described. A transversely extending bore 100 is provided through the post at an elevation 3" or 4" above the surface of the mat. With the posts 90 and 90A positioned in their respective assemblies 82 and 82A, a cross bar 110 may then be aligned with the post. The cross bar 110 is of suitable wood, aluminum or plastic material and defines a blind bore 112 at either end. The blind bore 112 has a diameter corresponding to that of the transverse bore in the individual posts. With the toe bar in position, locking pins 115 may be inserted from the outer edge of the post through the bore in the post and into the blind bore in the toe bar securing it in place. As seen in FIG. 6, the individual exercising can then sit on the mat surface with his or her feet positioned beneath the cross bar and in this position can perform a number of exercises for strengthening the abdominal muscles such as sit-ups, preferably of the bent-knee type which place less stress on the lumbar area.

With the toe bar in place as described above, the participant can perform additional exercises using elasticized bands such as band 125 which may be rubber tubing or a bungee-type cord. The band 125 is specifically designed to provide predetermined resistance through a full range of motion. The individual may loop the bands about one or both of the posts and from a sitting prone position can do resistance exercises. The bands can also be used to assist the individual in performing sit-ups. Preferably the bands are provided in different resistances for various physical levels and are suitably color coded.

To accommodate storage and transportation, the device may be easily taken down with the handles simply removed by unscrewing them from the threaded grommets at the stations. Similarly, the toe bar can be removed by removing the locking pins 115 at the end of the toe bar and unscrewing and removing the posts 90 and 90A. The posts, handles, toe bar and pins can be stored in a separate bag or in a pocket provided as part of the mat. To store the device, the mat sections are reversely folded along hinge sections 30 so the underside of sections 14 and 16 are adjacent one another. The mat sections can be secured in this position by fastener straps 132 and 132A positioned at spaced apart locations along edge 22A. The straps preferably are provided with a fastener such as a section 134 of loop and hook fastener material. A mating closure section 135, such as a mating portion of loop and hook fastener material, is provided at an aligned location inward of longitudinal edges 24 of section 14. An optional carrying strap 150 may be extended between straps 132 and 132A so that the strap may be positioned over the shoulder of the user for easy carrying. In this position, the folded device can be suspended from the wearer's shoulder and carried in a convenient position against the side of the user. It may be convenient to place one of the handles in the outwardly facing panel in carried position so that the user may grasp the handle to further assist in transporting the device.

It will be seen from the foregoing that the present invention provides a unique body exercise and stretching device which provides the user the benefits of both stretching and toning. Various types of floor exercises may be performed with the system and the significant advantages provided in that the user is provided a plurality of stations in which the handles may be inserted both for stability and to provide a quantitative gauge of the progress of the individual in the exercising and toning program. The user may orient herself or himself in any manner on the mat while performing exercises. While normally the user will sit near the edge with the stations in front of the user, other positions may be assumed depending on the specific exercises and user's needs.

It will be obvious to those skilled in the art to make various changes, alterations and modifications to the exercise and stretching system of the present invention. To the extent such changes, alterations and modifications do not depart from the spirit and scope of the appended claims, they are intended to be encompassed therein.

I claim:

1. A body exercising and stretching system comprising:

(a) first and second generally rectangular sections hingedly joined along an edge to form a mat, each of said sections having a generally rigid bottom panel with a resilient pad covering the upper surface of said panels and having an outer covering, said mat having opposite ends and opposite longitudinal sides;

(b) the upper surface of said mat having a defined seat area centrally positioned adjacent one end thereof;

(c) a plurality of exercise stations arranged on said mat surface arranged on lines generally diverging from said seat area toward said opposite end;

(d) at least one handle removably securable at any selected said exercise station whereby the user may assume a sitting position seated with the user's legs extended to allow the user to reach forward, grasping said handle for stability and to provide the user a progressive indication of exercise progress and flexibility.

2. The body exercising and stretching system of claim 1 further including a toe bar detachably engageable adjacent an edge of the mat sections opposite the seat.

3. The body exercising and stretching system of claim 1 wherein said mat surface is imprinted with instructional information to assist the user.

4. The body exercising and stretching system of claim 1 wherein said handle is in threaded engagement in receptacles in said mat.

5. The exercising and stretching system of claim 1 wherein said mat sections are foldable along said hinge with the bottom surfaces of said sections being adjacent in a folded position and further including fastener means releasably securing said sections in said folded position.

6. The exercising and stretching system of claim 1 wherein said stations comprise a grommet and wherein said handles have a generally cylindrical gripping surface and an end selectively engageable in said grommet.

7. The exercising and stretching system of claim 1 further including a toe bar detachably securable at fastening means adjacent an edge of the mat.

8. The exercising and stretching system of claim 7 wherein said fastening means for detachably engaging said toe bar comprises spaced-apart grommet means secured to said mat and each defining an internally threaded bore.

9. The exercising and stretching system of claim 8 wherein said toe bar comprises first and second posts, each having a body section and a threaded section engageable in said grommet means and further wherein said body sections each define a transversely extending bore and means for securing said toe bar in a horizontal position spaced from said mat at said bore in said post.

10. The exercising and stretching system of claim 9 further including an elastic band securable about said post for assisting in exercising.

11. The exercising and stretching system of claim 1 further including a carrying strap extending from at least one edge of said sections in said folded position.

12. The exercising and stretching system of claim 1 further including a padded seat area on the upper surface of the mat adjacent one edge of the mat and further wherein said plurality of stations are arranged diverging from said seat area.

* * * * *